US008713823B2

(12) United States Patent
Audet

(10) Patent No.: US 8,713,823 B2
(45) Date of Patent: May 6, 2014

(54) SKI TRACK MAINTENANCE SYSTEM

(76) Inventor: Carl Audet, St-Joseph-du-Lac (CA)

( * ) Notice: Subject to any disclaimer, the term of this patent is extended or adjusted under 35 U.S.C. 154(b) by 393 days.

(21) Appl. No.: 12/998,533

(22) PCT Filed: Oct. 22, 2009

(86) PCT No.: PCT/CA2009/001515

§ 371 (c)(1),
(2), (4) Date: Apr. 28, 2011

(87) PCT Pub. No.: WO2010/048700

PCT Pub. Date: May 6, 2010

(65) Prior Publication Data

US 2011/0203143 A1 Aug. 25, 2011

(30) Foreign Application Priority Data

Oct. 29, 2008 (CA) ..... 2642218

(51) Int. Cl.
*E01H 4/02* (2006.01)

(52) U.S. Cl.
USPC ..... 37/222

(58) Field of Classification Search
USPC ..... 37/219–224, 260, 261, 269; 172/72, 172/112
See application file for complete search history.

(56) References Cited

U.S. PATENT DOCUMENTS

| | | | | |
|---|---|---|---|---|
| 3,692,119 | A | 9/1972 | Tucker | 172/23 |
| 4,056,328 | A | 11/1977 | Maxey | 404/96 |
| 4,058,913 | A | 11/1977 | Esquilat | 37/50 |
| 4,163,329 | A * | 8/1979 | Neff | 37/222 |
| 4,244,662 | A | 1/1981 | Olson | 404/118 |
| 4,348,825 | A | 9/1982 | Bachler | 37/222 |
| 4,437,245 | A * | 3/1984 | Nigmela | 37/222 |
| 4,523,398 | A | 6/1985 | Scheibel et al. | 37/220 |
| 4,836,295 | A * | 6/1989 | Estes | 172/146 |
| 5,632,350 | A | 5/1997 | Gauvin | 180/9.44 |
| 5,809,671 | A * | 9/1998 | Sinykin | 37/219 |
| 6,354,023 | B1 | 3/2002 | Trahan et al. | 37/219 |
| 6,810,609 | B2 | 11/2004 | Lassonde et al. | 37/236 |
| 6,926,109 | B2 | 8/2005 | Thibault | 180/195 |
| 2003/0159840 | A1 | 8/2003 | Schmidt, Jr. | 172/145 |

FOREIGN PATENT DOCUMENTS

| | | |
|---|---|---|
| CA | 2064113 | 9/1993 |
| CA | 964055 | 3/1995 |
| CA | 2520280 A1 | 3/2007 |
| EP | 1 405 782 A1 | 4/2004 |

* cited by examiner

*Primary Examiner* — Robert Pezzuto
(74) *Attorney, Agent, or Firm* — Agence de Brevets Fournier; Claude Fournier

(57) ABSTRACT

A snow track maintenance system is described herein including a frame extending along an axis which is oriented along a direction of displacement, a mounting assembly secured to the frame for mounting the frame to a motorized vehicle so as to be trailed therefrom along the direction of displacement, and a leveler mounted to the frame so as to be pivotable relatively to the direction of displacement. Other equipments may further be provided to the maintenance system, including a snow regenerator mounted to the frame along a first longitudinal axis generally perpendicular to the direction of displacement, and a snow compactor mounted to the frame upstream from the snow regenerator. The system can be used for the maintenance of alpine ski tracks and cross-country ski tracks, even in an underbrush trail, and allows setting a track on any type of snow.

19 Claims, 5 Drawing Sheets

SKI TRACK MAINTENANCE SYSTEM

BACKGROUND

The simplest method of setting a cross-country ski track is for a snowmobile or small tractor to trail a conventional track setter along the ski track. However, drawbacks of this simple method include:

- the lack of penetration of the track setter in an aged snow or in an ice-covered snow;
- the low or non-compaction of the snow, which diminishes the longevity of the track; and
- the fact that snow on the track is not regenerated.

The use of the vehicle model BR60™ by Bombardier™ is free of this last drawback since it allows regenerating the snow. However, the dimensions of the vehicle are relatively too great to allow maintenance of an underbush snow track. Moreover, this piece of equipment is too heavy to be used on most type of snowy grounds.

Canadian Patent application No. 2,520,280, titled "Vehicule pour l'entretien de pistes de ski", filed on Sep. 20, 2005 by Carl Audet teaches a ski track maintenance system to be trailed by a tractor and having a snow generator, a compactor, a leveller and a track setter.

While this system by Audet solves most of the above-described drawbacks, it suffers from the following default:

- it does not allow making a reserve a snow or to move snow to a selected side of the system without frequently deviating from its course;
- the mounting of the track setter on the system is such that bumps or holes on the path bring instability to the track setter which cease to work for some times.

DETAILED DESCRIPTION

Figure 1:
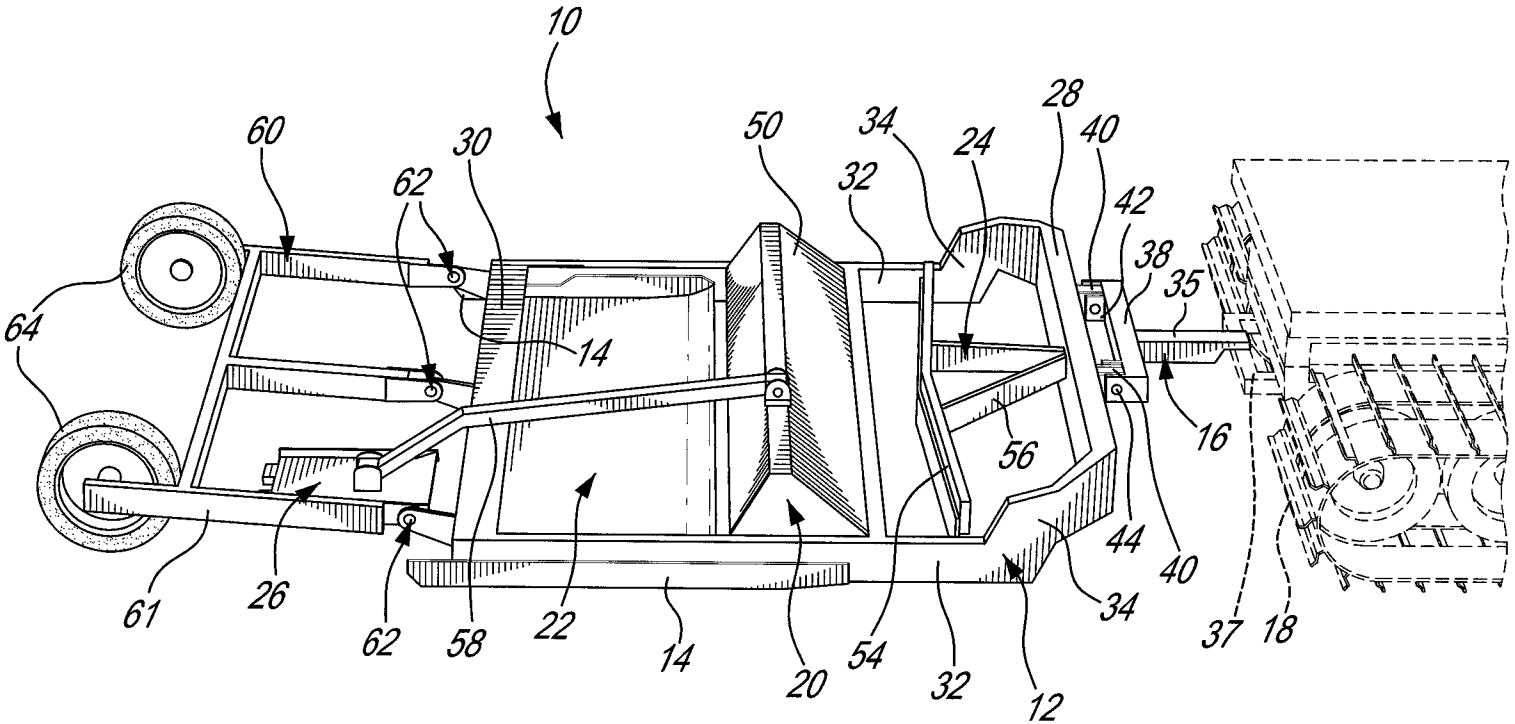
FIG. 1 is a perspective view of a ski track maintenance system according to a first embodiment of the present invention; the ski track maintenance system being illustrated attached to a tractor.

In the following description, similar features in the drawings have been given similar reference numerals, and in order not to weigh down the figures, some elements are not referred to in some figures if they were already identified in a precedent figure.

According to embodiments of the present invention, there is provided a snow track maintenance system comprising:

a frame extending along a first longitudinal axis;

a mounting assembly secured to the frame for mounting the frame to a vehicle so as to be trailed therefrom along a direction of displacement oriented along the first longitudinal axis; and a leveller mounted to the frame so as to be pivotable relatively to the direction of displacement and so as to contact a ground under the frame when the frame is mounted to the vehicle.

According to further embodiments of the present invention, there is provided a ski track maintenance system comprising:

a frame extending along a first longitudinal axis;

a mounting assembly secured to the frame for mounting the frame to a motorized vehicle downstream therefrom so as to move the frame along a direction of displacement oriented along the first longitudinal axis;

a snow regenerator mounted to the frame;

a snow compactor mounted to the frame downstream from the snow regenerator;

a leveller mounted to the frame upstream from the snow regenerator; and a track setter positioned downstream from the snow compactor and secured to the frame via a lever which biases the track setter towards a snowy ground when the ski track maintenance system lays thereon.

The use of the word "a" or "an" when used in conjunction with the term "comprising" in the claims and/or the specification may mean "one", but it is also consistent with the meaning of "one or more", "at least one", and "one or more than one". Similarly, the word "another" may mean at least a second or more As used in this specification and claim(s), the words "comprising" (and any form of comprising, such as "comprise" and "comprises"), "having" (and any form of having, such as "have" and "has"), "including" (and any form of including, such as "include" and "includes") or "containing" (and any form of containing, such as "contain" and "contains"), are inclusive or open-ended and do not exclude additional, unrecited elements.

A ski track maintenance system 10 according to a first embodiment of the present invention will be described with reference to FIGS. 1 to 3.

The ski track maintenance system 10 comprises a main frame 12, two parallel keels 14, a mounting assembly 16 for mounting the main frame 12 to a motorized vehicle 18, snow regenerator 20 and compactor 22, a leveller 24 and a track setter 26.

The main frame 12 is generally rectangular shaped and includes parallel front and back frame elements 28 and 30 and two parallel side frame elements 32, each transversally secured to both front and back frame elements 28 and 30 therebetween. The frame 12 further includes two smaller frame elements 34, interconnecting the front frame element 28 to a respective side frame element 32 so as to raise the front frame element 28 respective to the rest of the frame 12. More generally, the frame 12 is configured to allow its connection to the vehicle 18 via the mounting assembly 6 while bringing the functional components of the system 10 in operational relationship with the snowy ground when the system 10 is trailed by the vehicle 18.

The frame 12 also includes a support frame element 36 secured to both side frame elements 32 therebetween so as to be longitudinally distanced from the front and back frame elements 28 and 30. In addition to increasing the rigidity of the frame 12, the support frame element 36 contributes to securing the snow regenerator 20 to the frame 12.

The frame 12 allows functionally receiving the components 14, 16, 20, 22, 24 and 26 of the maintenance system 10, their relative positioning and their mounting to the vehicle 18 so as to be trailed thereby. The frame 12 is not limited to the illustrated embodiment 12 and can have other configurations including, without limitations, rounded and triangular.

The frame 12 extends along an axis 33 which defines a direction of displacement of the frame 12.

The frame 12 is made of a rigid material such as steel. The frame elements are assembled by welding or using fasteners (not shown).

The two parallel keels 14 are blade-like members, each secured to a respective one of the side frame elements 32 along thereto. The side frame elements 32 and the keels 14 are positioned generally parallel the direction of displacement for the frame 12 (see arrow 39 on FIG. 2). The keels 14 partially extend from under the frame 12 so as to yield a safe operational distance between the ground and the leveller 24 so as to protect the leveller 24 from rocks or any other small obstacles on the ground, especially at the start of a snow season.

The keels 14 are tapered, resulting in the end thereof nearest the back frame element 20 to extend farther from the side frame 32 than the front end of the keels. This contributes to raising the system 10 when it hits obstacles such as rocks or a tree stump (not shown).

The keels 14 further contribute to keeping the snow within the width of the maintenance snow device 10, contributing to forming a snow reserve and so as to prevent the snow from overflowing from both sides of the device 10. As will now become more apparent to a person skilled in the art upon reading the description hereinabove, the keels 14 allow increasing the performance of the maintenance system 10 and more specifically of the track setter 26 and of the leveller 24.

The keels 14 can be made longer, higher or thicker than the one according to the first embodiment. Its position on the frame may also vary depending, for example, on the configuration of the frame 18.

The mounting assembly 16 is in the form of a T bar including a first coupler portion 35, configured to be attached to a complementary coupling element 37 of the vehicle 18 and a second coupler portion 38 secured to the first coupler portion 36 transversally thereto.

The second coupling portion 38 is pivotally mounted to the front frame element 28. More specifically, the mounting assembly 16 further includes two connecting elements 40 secured to the front frame element 28. The two connecting elements 40 are received in U-shaped brackets 42 which are secured to the second coupling portion 38 perpendicularly thereof. The two connecting elements 40 are pivotally mounted in the brackets 42 via pivot pin 44. The system 10 is thus allowed to pivot about and axis defined by the pin 44 and which is parallel the front frame element 28. Also, the mounting of the first coupler portion 35 to the coupling element 37 of the vehicle 18 allows pivoting of the system 10 from side to side so that the system 10 defines an angle with the vehicle 18 within a plane generally defined by the frame 12.

The mounting assembly is not limited to the illustrated embodiment 16 and can have any other structure allowing mounting of the frame 12 to a vehicle so that the system 10 is allowed to pivot within two perpendicular axes. According to another embodiment, the frame 12 is rigidly mounted to the vehicle 18. According to still another embodiment, the frame 12 is mounted to the vehicle 18 via a universal mount (not shown). According to a further embodiment, the mounting assembly includes cylinders or any other means to actuate the pivoting of the frame relative to the trailing vehicle. The actuation can be powered, for example, by a PTO from the vehicle and commanded therefrom. Such actuating means could allow for example the raising of the front portion of the frame so as to adapt the system for the quantity of snow.

The system 10 according to the first embodiment is adapted to be trailed by a tractor 18 provided with snow tracks. The system 10 and more specifically its mounting assembly 16 can be modified so as to be adapted to another type of vehicle. Also, the tractor 18 is provided with a PTO (Power Take-Off) that is used to power motorized components of the system 10.

A ski track maintenance system according to a further embodiment (not show), includes an independent power source, such as, without limitations, a motor.

Moreover, the expression "mounting assembly" should not be construed limitedly and should be construed so as to include any structure or parts allowing attaching the functional components of the maintenance system behind the vehicle 18 so as to be trailed thereby.

The snow regenerator 20 includes a spiked roll 46 rotatably mounted to the two side frame elements 32 via pivot pins 48 so as to be generally aligned perpendicularly to the direction of displacement 37. A protective cap 50 is mounted to the frame 12 between the two side frame elements 32.

The snow regenerator 20 allows breaking and lifting the snowy ground or slicing and lifting an icy ground to create powder snow. The cap 50 allows preventing the snow processed by the regenerator 20 to be moved outwardly and out of the device 10 thereby increasing the efficiency of the regenerator 20. Indeed, the efficiency of the snow regenerator 20 is further determined by the diameter of the roll 46 and the configuration and density of the spikes 49 thereon. According to the first embodiment of the maintenance system 10, the spikes 49 on the roll 46 are L-shaped.

The rotation of the roll 46 can be powered. According to such an embodiment, the power is provided to the regenerator 20 by the PTO (power take-off) of the vehicle 10. Conventional electrical and/or mechanical couplers (not shown) are of course provided to allow powering and control of the snow regenerator from inside the vehicle 18.

The snow regenerator is not limited to the illustrated embodiment and can have any other configuration allowing breaking the snowy and/or icy ground.

The compactor 22 is in the form of a heavy plate, including an undersurface and being mounted to the frame 12 between the regenerator 20 and the back frame element 30 so that the undersurface contact the snowy ground. The undersurface of the compacter/waver 22 includes clouts 52.

The compactor 22 is provided to fill cavities on the snowy ground, to level it and to compact it.

According to the first embodiment, the compactor 22 yields a pressure of about 1.5 metric tons distributed under a width of about 2 meters, yielding a compacting force of about 666 kg to the linear meter. Such a compacted snow allows the track to receive more skiers before its deterioration.

According to a further embodiment, the compactor is configured so as to yield a greater or lesser compacting force than the compactor 22.

The compactor is not limited to the above described embodiments and can have any size and configuration allowing evening and compacting the snow.

Also, the frame 12 or any of the components of the maintenance system 10 can be configured to act as ballast that adds weight to a flat surface under the device 10 which then acts as a compactor.

The leveller 24 is mounted to the frame 12 upstream from the snow regenerator 20 so as to be generally parallel to the front frame element 28 and therefore generally perpendicular to the axis 33.

The leveller 24 includes a snow pusher 54 in the form of an angled elongated plate 54 pivotally mounted to the front frame element 28 via a mounting member 56.

More specifically, the angled plate 54 defines a V-shaped member which is widely opened on the side of the mounted assembly 16. The V-shaped member 54 is fixedly mounted to the mounting member 56 which is pivotally mounted to the front frame element 28 via two cylinders (not shown). The cylinders are hydraulically actuated by the PTO of the vehicle 18 and are commanded therefrom so as to pivot the member 54 to the left or to the right. The neutral position of the V-shaped member 54 corresponds to its symmetrically positioning relative to the mounting assembly 16 or to the axis 39.

The pivotable leveller 24 aims at leveling a snow track and for that purpose the leveller 24 allows keeping a reserve of snow to fill cavities on the ground crossed by the maintenance system 10. The pivotable leveler 24 further contributes to removing bumps on the track.

In operation, the leveller 24 is pivoted towards a selected side so as to transfer snow on the opposite side.

A track maintenance system according to another embodiment of the present invention includes a leveller which is fixedly mounted to the frame 12.

The track setter 26 includes two ski templates 57 mounted to the frame 12 via the mounting cap 50 of the snow regenerator 20 using an elongated pole 58 that positions the two ski templates 57 behind the compactor 22. The pole 58 includes an angled portion to force the templates 57 to the ground. The distanced positioning of the attachment of the track setter 26 relative to the distal edge 30 of the frame 12 allows improving the stability of the track setter 26 and therefore of its setting compared to an identical setter attached to the distal edge 30 for example. Indeed, it has been found that with such an arrangement, one of the two ski templates 57 hitting an obstacle on the ground would be less inclined to cause the whole track setter 26 to deviate from its course.

The track setter 26 can be omitted when the snow track maintenance system 10 is used for the maintenance of different snow tracks then a cross-country ski track (now shown), including without limitation, alpine ski tracks.

According to a further embodiment, the system 10 also includes a sub-system (not shown) to raise or lower the track setter 26. Such a sub-system may, for example, include a hydraulic cylinder secured to both the pole 58 and the cap 50, energized by the vehicle PTO and commanded from the vehicle cabin.

The leveller 24, snow regenerator 20, compacter/waver 22, conventional track setter 26 and the keels 14 are all mounted to the frame 12 and relatively to each other so as to be operatively positioned when the track setter 10 lays on a snowy ground (not shown).

The snow maintenance system 10 further comprises a carrier assembly 60 pivotally mounted to the main frame 12 so as to be movable between a first raised position, as illustrated in FIG. 1, and a second lowered position (not shown).

The carrier 60 is in the form of a secondary frame 61, pivotably mounted to the main frame 12 via lockable pivot assemblies 62 secured to the secondary frame 61 at the proximate end thereof and further includes two wheels 64 mounted to the secondary frame 61 at the distal end thereof. The pivot assemblies 62 allow locking the secondary frame 61 in either one of its raised and lowered positions.

Positioning the carrier 60 in its lowered position causes the main frame 12 to be raised relatively the secondary frame 61 thereby allowing the vehicle 18 or any other vehicle to transport the maintenance system 10 out of snow without damaging the components thereof.

Conversely, the carrier 60 can be positioned in its raised position when the snow track maintenance system 10 operates for the maintenance of a snow track.

According to a further embodiment, the wheels 64 are directly mounted to the main frame 12 via a mechanism (not shown) allowing their lowering or raising relative to the other functional components of the system 10.

The mechanism provided to raise or lower the wheels lockable pivot assemblies 62 or the lockable pivot assemblies 62 can include hydraulic or pneumatic cylinders.

Of course, the number and configuration of the wheels 64 can be different than those illustrated hereinabove.

According to further embodiments, the wheels 64 of the carrier 60 are replaced or complemented by skis (not shown). Snow tracks (not shown) can also be used.

Also, a snow track maintenance system similar to the system 10 but wherein the track setter 26 is omitted can be used to pave alpine ski slopes (not shown) for example.

Also, maintenance systems according to further embodiments of the present invention can be provided wherein the snow regenerator the snow compactor and the track setter are omitted. Applications for such systems include military snow track and forester snow track maintenance.

A system 70 for the maintenance of snow tracks according to a second embodiment of the present invention will now be described with reference to FIGS. 4 and 5.

The system 70 comprises a frame 72, a mounting assembly (not shown) for mounting the frame 72 to a motorized vehicle (not shown), a snow compactor 74, two carrying wheels 75, two parallel keels 76 and a leveller assembly 78.

The frame 72 includes a higher rectangular frame element 80 having proximate and distal transversal end sides 82 and 84, a longitudinal tubing 86 which defines a longitudinal axis of the system 70, two legs 88 and a lower frame elements 90.

The longitudinal tubing 86 is secured to the rectangular frame element 80 in the middle thereof. The rectangular frame element 80 is so configured and sized as to have a front portion thereof positioned higher than the tubing 86 and a back portion lower than the tubing 86.

The portion 92 of the tubing 86, which extends beyond the proximate end side 82 of the frame element 80 defines an inverted V-shape. The V-shape portion 92 provides room thereunder to allow room for high components at the back of the vehicle to which the system 70 is mounted.

The two legs 88 are secured to the frame element 80 and extend downwardly from the distal end side 84 thereof.

The lower frame element 90 is secured to both legs 88 at the distal end thereof and further rest on the snow compactor 74. This allows to efficiently transfer weight from the frame 72 to the compactor 74.

The snow compactor 74 is secured to both the lower frame element 90 and to the legs 88.

The snow compactor 74 is in the form of a heavy plate having a ski-shaped section. The snow compactor 74 shares the same purpose than the snow compactor 22. According to a further embodiment, the snow compactor 22 may further includes clouts (not shown).

Figure 2:
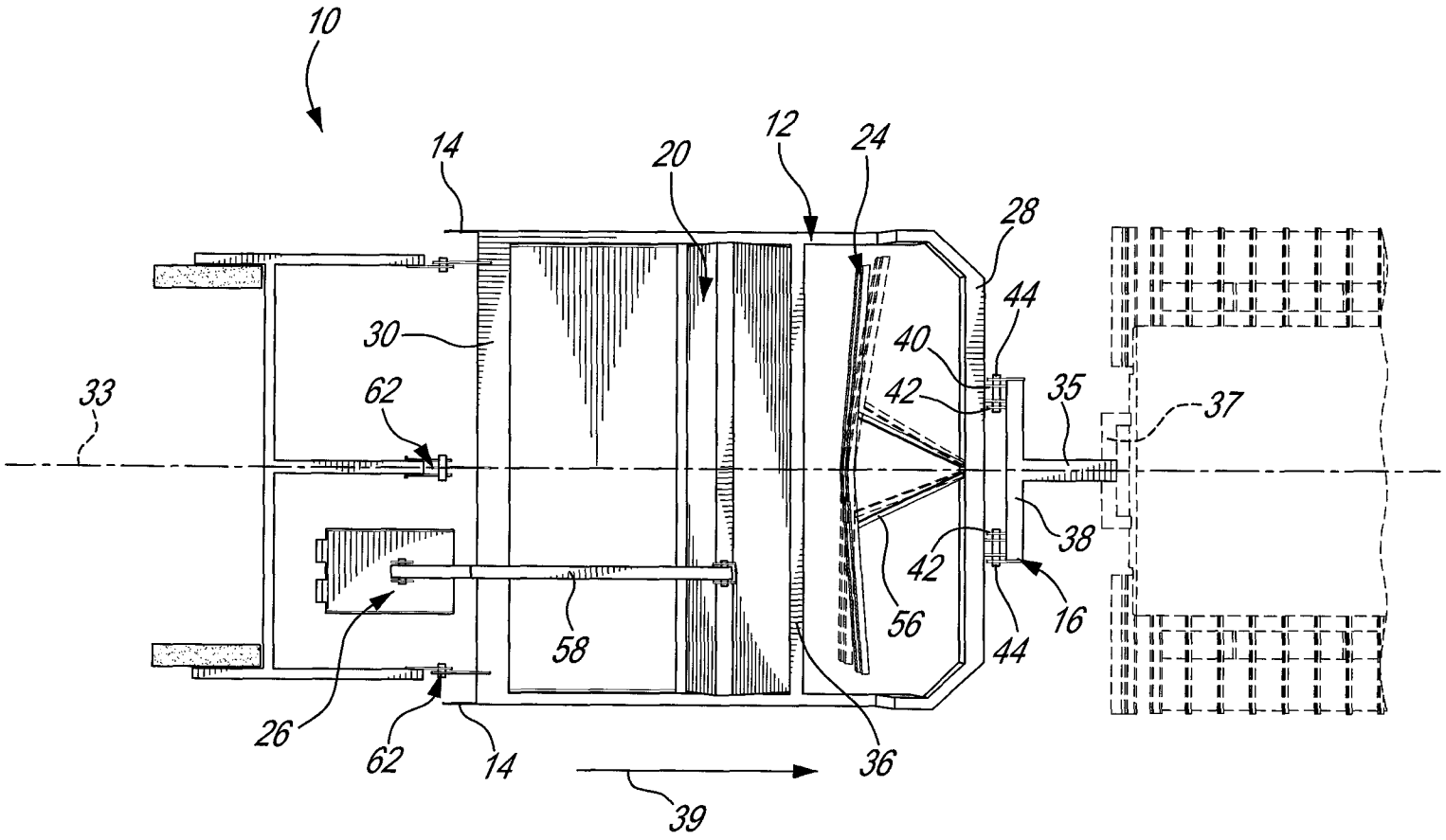
FIG. 2 is a top plan view of the ski track maintenance system from FIG. 1.
Figure 3:
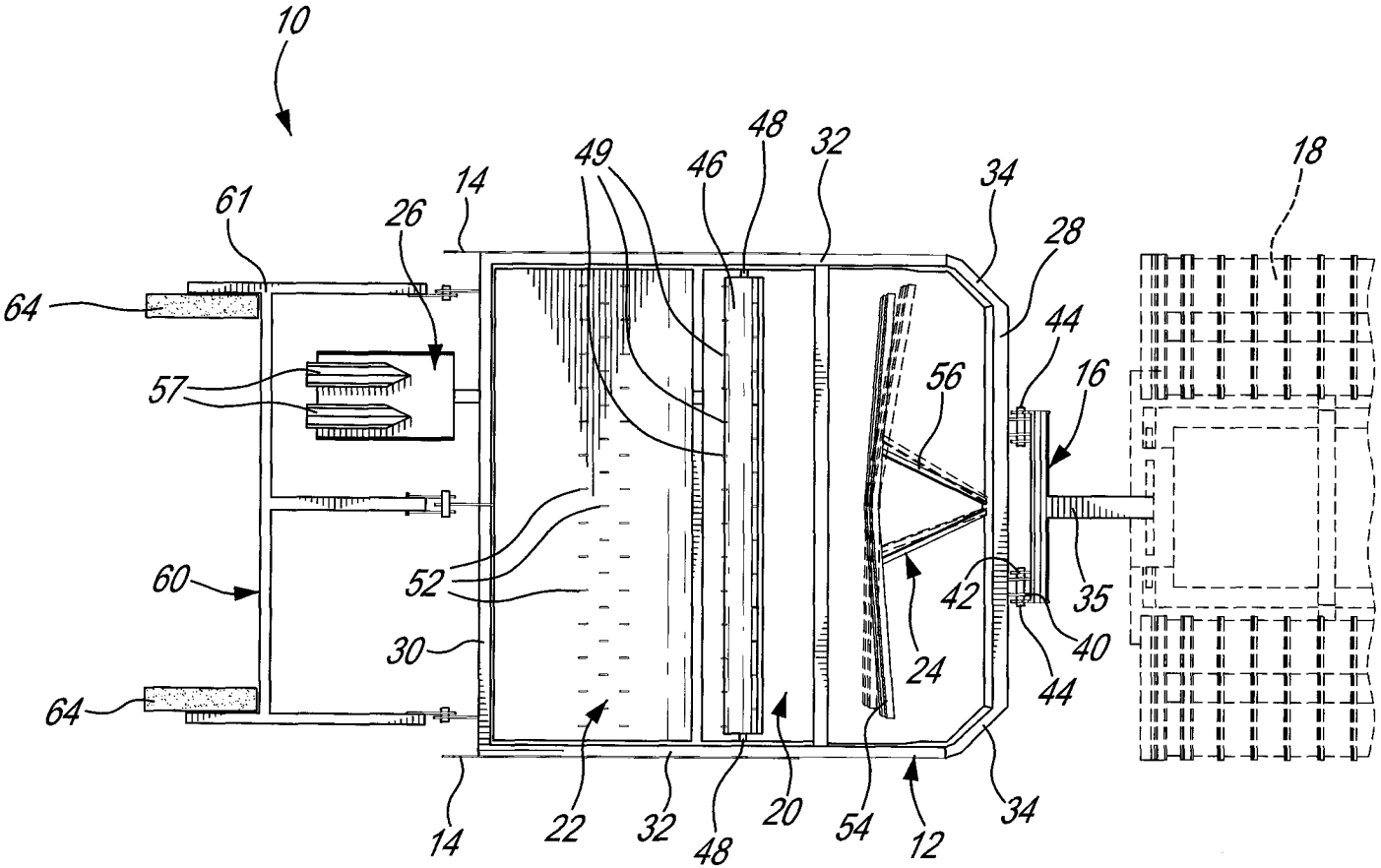
FIG. 3 is a bottom plan view of the ski track maintenance system from FIG. 1.

The keels 76 are secured to the snow compactor 74 on respective lateral sides thereof and share similar purposes with the keels 14 show in FIGS. 1 to 3.

Figure 5:
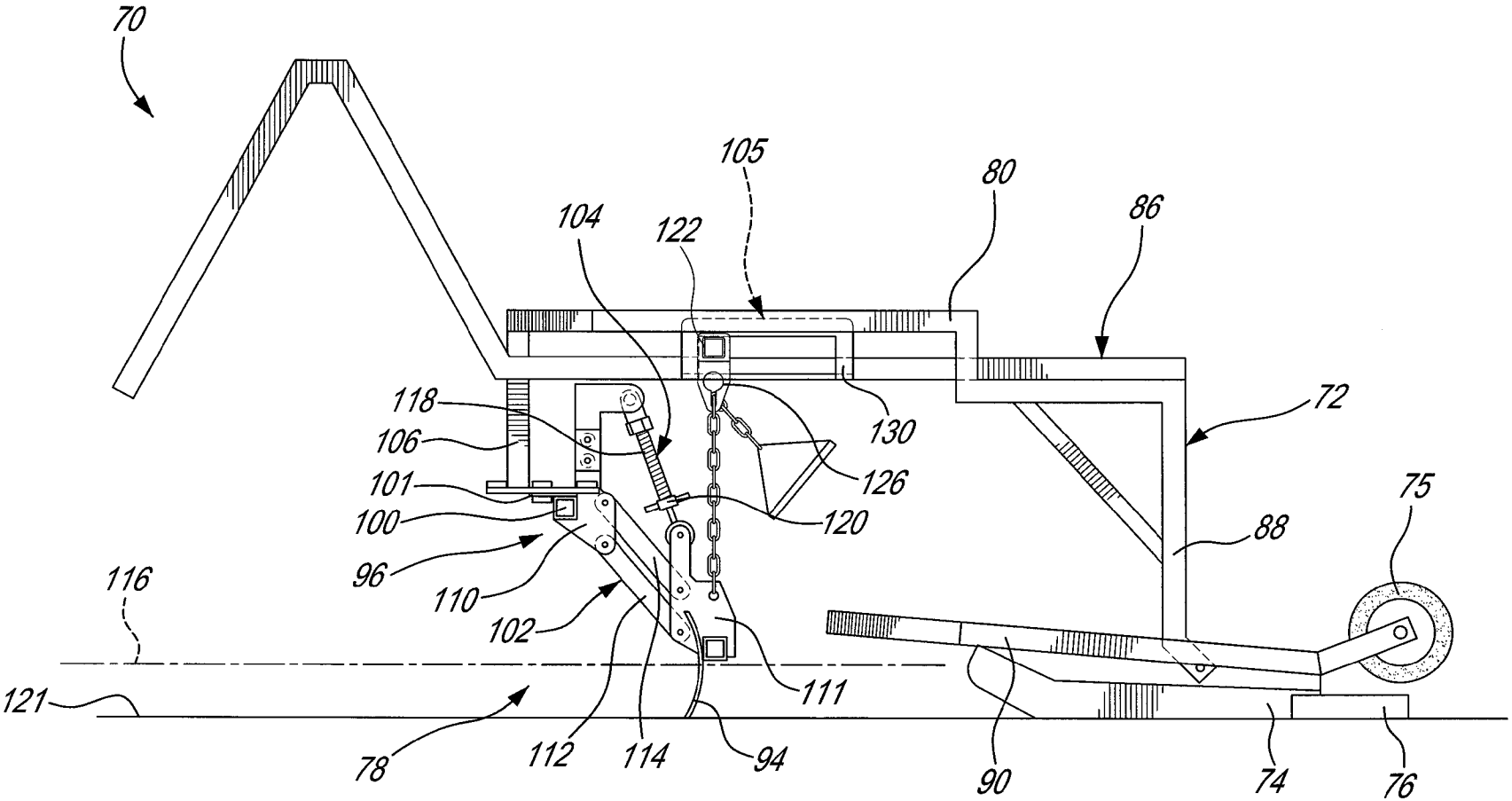
FIG. 5 is a side elevation of the maintenance system from FIG. 4.

The carrying wheels 75 are pivotally mounted to the lower frame element 90 or to the compactor 74 so as to be pivotable between an upward position, as illustrated in FIG. 5, and a downward position, wherein the wheels 75 are at the lowermost position of the system 70 so as to allow trailing of the system 70 for its displacement for example on non-snowy ground (not shown).

The leveller assembly 78 includes a snow pusher 94 pivotally mounted to the frame 72 and more specifically to the longitudinal tubing 86 of the frame 72 via a pusher positioning system 96.

The pusher 94 is arc shaped to maximize penetration of the pusher 94 in the snow and to allow the pusher 94 to maximize the amount of snow carried.

The pusher positioning system 96 includes a multi-position plate 98 fixedly mounted to the frame element 80 thereunder, a mounting bar 100 pivotally mounted to the plate 98, two parallel arm arrangements 102 for mounting the pusher 94 to the mounting bar 100, two tensioning mechanisms 104 mounted to the bar 100 and to a respective arm arrangement 102 therebetween for biasing the snow pusher 94 to a predetermined position relative to the central tubing 86, and a snow pusher retracting arrangements 105, mounted to both the tubing 96 and the arm arrangements 102 therebetween, for moving the snow pusher 94 between an operating position (illustrated in FIG. 5) and a retracted position wherein the snow pusher 94 is moved towards the tubing 86 so as, for example, allowing displacing the system 70 without risking damaging the snow pusher 94.

The plate 98 is mounted to the frame element 80 via a tubing element 106 that distances the plate 98 from the frame element 80.

The mounting bar 100 is pivotally mounted to the plate 98 via a pivot rod 108. The plate 98 further includes three (3) holes 107 therein for receiving stopper 109 that allows blocking the bar 100 in any one of the following three positions relative to the tubing 86: perpendicular, as illustrated in FIGS. 4 and 5, and pivoted to the right (as illustrated in dashed line in FIG. 4) or to the left so as to show a predetermined angle with the tubing 86. According to the illustrated embodiment, this angle is about 45 degrees. A plate 101 secured to the bar 100 includes a hole (not shown) to receive the stopper 109 so as to block the bar 100 in any one of the three above-described positions.

Of course, the configuration of the plate 98 can be different so as to allow more or less than three positions and so as to allow manually positioning the snow pusher 94 at different angles than 45 degrees.

According to a further embodiment (not shown), an automatic mechanism, commanded for example from the vehicle (not shown) is provided between the plate 98 so as to modify the angle of the snow pusher 94 according to discrete or infinite values.

Each of the two parallel arm arrangements 102 includes a first end plate 110, secured to a respective longitudinal end of the bar 100, a second end plate 111, secured to snow pusher 94 near a respective longitudinal end thereof, and two parallel arm elements 112 and 114, each pivotally mounted to both plates 110 and 111 so as to allow varying the level of the pusher 94 relative to the bar 100 and to the central tubing 86 while maintaining the symmetrical axis 116 of the pusher 94 parallel to the tubing 86.

Each of the tensioning mechanisms 104 includes biasing member 118, in the form of a push spring, mounted about a threaded rod and an adjustment handle 120 for varying the length of the tensioning mechanism 104 and therefore the level of the snow pusher 94 relative to the ground 121.

The pusher retracting arrangement 105 includes a bar 122 positioned over the tubing 86 so as to rest thereon and maintained in parallel relationship with the snow pusher 94 by two chains 124 fixedly attached at one end to a respective plate 111 and to the other end to the bar 122. A pair of key seat attachment 126 secured to the bar 122 is provided to receive the chains 124 and to allow varying their length so as to allow raising and lowering the snow pusher 94 as described hereinabove. A handle 128 is provided at the free end of each chain 124 to ease the manipulation thereof.

The bar 122 is prevented from tilting or falling from the tubing 86 by two inverted U-shaped members 130 secured to the central tubing 86 via an underplate 132.

According to further embodiments, a different frame than the frame 72 is provided to positions the level assembly 78 relative to the snowy ground 121.

Figure 4:
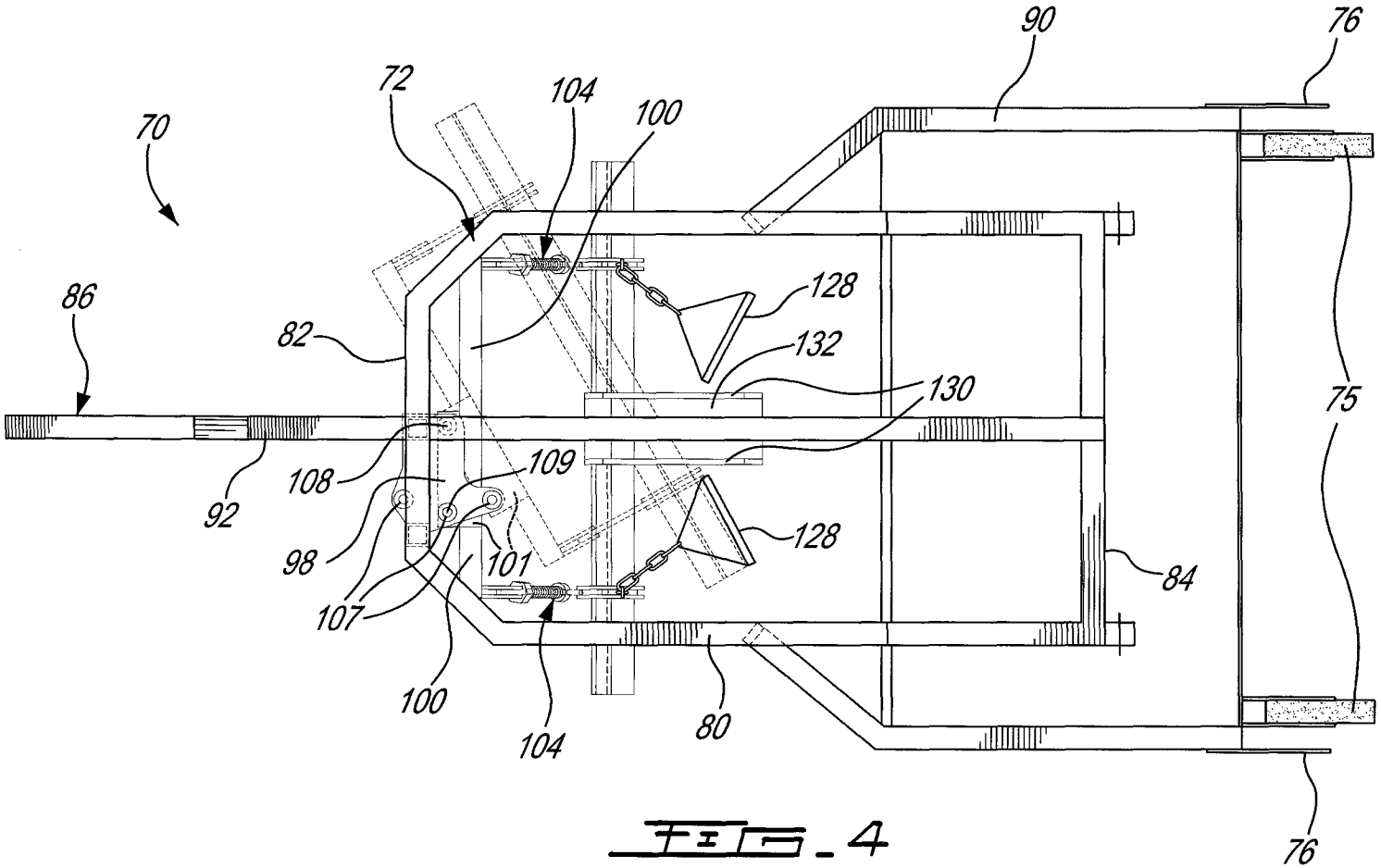
FIG. 4 is a top plan view of a ski track maintenance system according to a second embodiment of the present invention.

It is to be noted that leveller assemblies of snow track maintenance systems according to embodiments of the present invention are not limited to the illustrated embodiment of FIGS. 4 and 5. For example, the snow pusher can have another configuration. Also, the tensioning mechanism 104 and/or pusher retracting arrangement 105 can be omitted.

Even though the snow track maintenance systems 10 and 70 have been described as being equipped with a leveller which is pivotable, a snow track setter according to another embodiment of the present invention can be equipped with a leveller which is fixedly mounted to the frame so as to be generally perpendicular with the direction of displacement of the frame.

The expression "bar", "rod" and "frame element" are used for clarity purposes and should not be construed in any limited way. Each of these elements represents a rigid member allowing to mount the elements of the system relatively to each other in a functional manner as described hereinabove.

Any one of fasteners, welding or mechanical coupling can be used to assemble the frame elements and the various other components of the system 10 or 70.

The invention claimed is:

1. A snow track maintenance system comprising:

a frame extending along a first longitudinal axis;

a mounting assembly secured to the frame for mounting the frame to a vehicle so as to be trailed therefrom along a direction of displacement oriented along the first longitudinal axis; and a leveller mounted to the frame so as to be pivotable relatively to the direction of displacement towards a selected lateral side of the frame and so as to contact a snowy ground under the frame when the frame is mounted to the vehicle.

2. A snow track maintenance system as recited in claim 1, further comprising:

a snow regenerator operatively mounted to the frame downstream from the leveller; and a snow compactor operatively mounted to the frame downstream from the snow regenerator.

3. A snow track maintenance system as recited in claim 2, wherein the snow regenerator includes a roll rotatably mounted to the frame so as to at least partially extend from the frame.

4. A snow track as recited in claim 3, wherein the roll is spiked.

5. A snow track as recited in claim 3, wherein the roll is powered.

6. A snow track maintenance system as recited in claim 2, wherein the snow regenerator is covered by a cap.

7. A snow track maintenance system as recited in claim 2, wherein the snow regenerator is positioned along the longitudinal axis on a side of the snow compactor nearest the mounting assembly.

8. A snow track maintenance system as recited in claim 2, wherein the snow compactor is in the form of a plate having an under surface and being mounted to the frame so that the under surface contacts the snowy ground.

9. A snow track maintenance system as recited in claim 1, wherein the leveller includes a snow pusher.

10. A snow track maintenance system as recited in claim 9, wherein the leveller includes a snow pusher mounted to the frame via a pusher positioning assembly including a mounting bar pivotally mounted to the frame thereunder and two parallel arm arrangements for mounting the snow pusher to the mounting bar and to force a parallel relationship between the snow pusher and the mounting bar when the snow pusher is moved towards the frame.

11. A snow track maintenance system as recited in claim 10, wherein the pusher positioning assembly further includes at least one of a tensioning assembly for creating an adjustable force by the pusher on the snowy ground and a pusher raising assembly form moving the pusher from a lower operating position to a raised non-operating position.

12. A snow track maintenance system as recited in claim 1, further comprising:

two parallel keels mounted to the frame so as to be oriented along the direction of displacement of the frame and so as to contact the snow track when the snow maintenance system lays on the snowy ground.

13. A snow track maintenance system as recited in claim 12, wherein each of the keels includes a blade-like member.

14. A snow track maintenance system as recited in claim 12, wherein the keels are mounted to the frame on opposite lateral sides thereof.

15. A snow track maintenance system as recited in claim 12, wherein the keels are tapered from front to back.

16. A snow track maintenance system as recited in claim 1, further comprising a track setter.

17. A snow track maintenance system as recited in claim 1, wherein the mounting assembly is configured for mounting the frame to the vehicle so as to provide pivotal movements of the frame relative to the vehicle about two perpendicular pivot axes; both pivot axies being further perpendicular to the longitudinal axis and one of the two pivot axis being generally perpendicular to the snowy ground.

18. A snow track maintenance system as recited in claim 1, further comprising a carrier assembly mounted to the frame so as to be movable between i) a lowered position wherein the leveller contacts the snowy ground and ii) a raised position wherein the leveller does not contact the snowy ground.

19. A ski track maintenance system comprising:

a frame extending along a first longitudinal axis;

a mounting assembly secured to the frame for mounting the frame to a motorized vehicle downstream therefrom so as to move the frame along a direction of displacement oriented along the first longitudinal axis;

a snow regenerator mounted to the frame;

a snow compactor mounted to the frame downstream from the snow regenerator;

a leveller mounted to the frame upstream from the snow regenerator so as to be pivotable relatively to the direction of displacement towards a selected lateral side of the frame and so as to contact a snowy ground under the frame when the frame is mounted to the vehicle; and a track setter positioned downstream from the snow compactor and secured to the frame via a lever which biases the track setter towards a snowy ground when the ski track maintenance system lays thereon.

* * * * *